US011661257B2

(12) United States Patent
Vanderpan et al.

(10) Patent No.: US 11,661,257 B2
(45) Date of Patent: May 30, 2023

(54) DOUBLE DOOR RESTRAINING DEVICE AND METHOD

(71) Applicant: DOORFRAMER, INC., Lincoln, CA (US)

(72) Inventors: Dave Vanderpan, Lincoln, CA (US); Del Vanderpan, Lincoln, CA (US)

(73) Assignee: DOORFRAMER, INC., Lincoln, CA (US)

( * ) Notice: Subject to any disclaimer, the term of this patent is extended or adjusted under 35 U.S.C. 154(b) by 0 days.

(21) Appl. No.: 17/722,708

(22) Filed: Apr. 18, 2022

(65) Prior Publication Data

US 2022/0234806 A1 Jul. 28, 2022

Related U.S. Application Data

(62) Division of application No. 16/580,980, filed on Sep. 24, 2019, now Pat. No. 11,332,295.

(60) Provisional application No. 62/750,222, filed on Oct. 24, 2018.

(51) Int. Cl.

| | |
|---|---|
| ***B65D 85/00*** | (2006.01) |
| ***B65D 81/05*** | (2006.01) |
| ***B65D 85/64*** | (2006.01) |
| ***E06B 7/28*** | (2006.01) |
| ***E04F 21/00*** | (2006.01) |

(52) U.S. Cl.

CPC ..... *B65D 81/057* (2013.01); *B65D 85/64* (2013.01); *E04F 21/0023* (2013.01); *E06B 7/28* (2013.01); *B65D 2581/055* (2013.01); *B65D 2585/647* (2013.01)

(58) Field of Classification Search

CPC . E06B 1/6069; E06B 1/34; E06B 1/64; E06B 1/68; E06B 7/2316; E06B 7/26; E06B 7/28; E06B 3/9636; E06B 1/28; E06B 3/22; E06B 1/524; E06B 7/2312; E05Y 2900/32; E05Y 2900/48; B65D 81/057; B65D 2581/055; B65D 2585/647; E04F 21/0023

USPC ..... 52/215, 211, 204.1, 58, 56, 126.3, 213, 52/212; 49/380, 466, 475.1, 490.1

See application file for complete search history.

(56) References Cited

U.S. PATENT DOCUMENTS

| | | | |
|---|---|---|---|
| 1,316,467 | A | 9/1919 | Tollis |
| 1,376,686 | A | 5/1921 | Fleckner |
| 1,667,279 | A | 4/1928 | Allen |
| 1,886,531 | A | 11/1932 | Dalchow |
| 2,462,442 | A | 2/1949 | Wallace |
| 2,489,029 | A | 11/1949 | Guerrant |
| 2,742,146 | A | 4/1956 | Lester, Jr. |
| 2,844,913 | A | 7/1958 | Brill, Jr. |
| 2,887,219 | A | 5/1959 | Lester, Jr. |
| 2,903,323 | A | 9/1959 | Westford |
| 2,929,495 | A | 3/1960 | Simonsen |

(Continued)

FOREIGN PATENT DOCUMENTS

| | | |
|---|---|---|
| CA | 568764 | 1/1959 |
| DE | 101266 | 10/1897 |

(Continued)

*Primary Examiner* — Chi Q Nguyen

(74) *Attorney, Agent, or Firm* — Manatt, Phelps & Phillips, LLP

(57) ABSTRACT

A double door assembly bottom restraining device and method provide stability to the double door assembly during manufacturing and shipping. The double door assembly bottom restraining device may be installed on the bottom of a double door assembly.

14 Claims, 9 Drawing Sheets

(56) References Cited

U.S. PATENT DOCUMENTS

| | | | | |
|---|---|---|---|---|
| 2,931,603 | A | | 4/1960 | Johnston et al. |
| 3,017,022 | A | | 11/1962 | Amundson |
| 3,111,724 | A | | 11/1963 | Piekarski |
| 3,205,982 | A | | 9/1965 | Chimienti |
| 3,301,820 | A | | 1/1967 | Haendiges |
| 3,593,458 | A | | 7/1971 | Wahfield et al. |
| 3,618,261 | A | | 11/1971 | Torbetter |
| 3,668,906 | A | | 6/1972 | Josephart |
| 3,739,525 | A | | 6/1973 | Rybak |
| 3,800,365 | A | | 4/1974 | Bruggert |
| 3,893,647 | A | | 7/1975 | Kennedy |
| 3,983,602 | A | | 10/1976 | Barry |
| 3,987,956 | A | | 10/1976 | Congleton |
| 4,024,604 | A | | 5/1977 | Klimek et al. |
| 4,050,187 | A | | 9/1977 | Geiger et al. |
| 4,099,299 | A | | 7/1978 | Bruggert et al. |
| 4,176,494 | A | | 12/1979 | Boucher et al. |
| 4,201,013 | A | | 5/1980 | Robbins |
| 4,483,101 | A | | 11/1984 | Berzina |
| 4,518,279 | A | | 5/1985 | Suttles |
| 4,615,140 | A | | 10/1986 | Frano |
| 4,620,389 | A | | 11/1986 | Coulson |
| 4,635,886 | A | | 1/1987 | Santucci et al. |
| 4,636,105 | A | | 1/1987 | Johansson |
| 4,709,889 | A | | 12/1987 | Erickson |
| 4,718,195 | A | | 1/1988 | Ortega |
| D307,078 | S | | 4/1990 | Guillemet |
| 4,922,654 | A | | 5/1990 | Hawke |
| 4,942,704 | A | | 7/1990 | King |
| D319,007 | S | | 8/1991 | Rogers et al. |
| 5,052,086 | A | | 10/1991 | Nasuno |
| 5,054,613 | A | | 10/1991 | Johansson |
| 5,056,198 | A | | 10/1991 | Viglione |
| 5,159,782 | A | | 11/1992 | Sales |
| 5,167,091 | A | | 12/1992 | Schroeder |
| 5,209,017 | A | | 5/1993 | Ridge |
| 5,210,973 | A | | 5/1993 | Kratky et al. |
| 5,255,727 | A | | 10/1993 | Saruwatari et al. |
| 5,312,078 | A | | 5/1994 | Marsh |
| 5,358,423 | A | | 10/1994 | Burkhard et al. |
| 5,365,697 | A | | 11/1994 | Vanderpan |
| 5,463,189 | A | | 10/1995 | Deneke et al. |
| 5,473,839 | A | | 12/1995 | Stidham |
| 5,474,268 | A | | 12/1995 | Yu |
| 5,542,209 | A | | 8/1996 | Sheu |
| 5,562,315 | A | | 10/1996 | Sales |
| 5,565,254 | A | | 10/1996 | Norvell |
| 5,603,403 | A | | 2/1997 | Sather |
| 5,617,672 | A | | 4/1997 | Garrett |
| 5,635,697 | A | | 6/1997 | Shellhammer et al. |
| 5,641,061 | A | * | 6/1997 | de Muylder-Braun ... A47F 7/02 206/6.1 |
| 5,655,332 | A | | 8/1997 | Papadopoulos |
| 5,722,203 | A | | 3/1998 | Staples et al. |
| 5,787,639 | A | | 8/1998 | Lamore |
| 5,819,374 | A | | 10/1998 | Chiles et al. |
| 5,857,429 | A | | 1/1999 | Hostetler |
| 5,863,471 | A | | 1/1999 | Stanek |
| 5,924,259 | A | | 7/1999 | Marousek |
| 6,029,410 | A | | 2/2000 | Westberg, II et al. |
| D427,894 | S | | 7/2000 | Benz et al. |
| 6,170,198 | B1 | | 1/2001 | Staples et al. |
| 6,170,212 | B1 | * | 1/2001 | Suchyna ..... E04F 15/10 52/471 |
| 6,223,489 | B1 | * | 5/2001 | Fisher ..... E04B 5/46 52/307 |
| 6,276,526 | B1 | | 8/2001 | Miller et al. |
| 6,301,828 | B1 | | 10/2001 | Vanderpan |
| 6,343,772 | B1 | | 2/2002 | Oi |
| 6,357,181 | B1 | | 3/2002 | Triemstra |
| 6,357,200 | B1 | | 3/2002 | Vanderpan |
| 6,378,175 | B1 | | 4/2002 | Vanderpan |
| 6,443,401 | B1 | | 9/2002 | Vanderpan |
| 6,470,637 | B2 | | 10/2002 | Gratz |
| 6,488,247 | B1 | | 12/2002 | Gonzalez |
| 6,532,704 | B2 | | 3/2003 | Hart |
| 6,725,604 | B1 | | 4/2004 | Vanderpan |
| 6,968,954 | B2 | * | 11/2005 | Hsieh ..... B65D 81/133 206/592 |
| 7,213,371 | B1 | | 5/2007 | Vanderpan |
| 8,662,307 | B2 | | 3/2014 | Pitt |
| 10,294,716 | B2 | * | 5/2019 | Ege ..... E06B 7/28 |
| 10,954,051 | B1 | | 3/2021 | Vanderpan et al. |
| 11,332,295 | B1 | * | 5/2022 | Vanderpan ..... B65D 81/057 |
| 2001/0042813 | A1 | | 11/2001 | Taylor |
| 2004/0060241 | A1 | | 4/2004 | Staples et al. |
| 2004/0144685 | A1 | * | 7/2004 | Stapleton ..... B65D 81/055 206/586 |
| 2016/0319557 | A1 | * | 11/2016 | Gordon ..... E04F 21/0015 |

FOREIGN PATENT DOCUMENTS

| | | |
|---|---|---|
| DE | 392148 | 6/1922 |
| DE | 823064 | 11/1951 |
| FR | 2232988 | 1/1975 |
| FR | 2247157 | 5/1975 |
| JP | H0667786 A | 3/1994 |
| SU | 1464965 | 3/1989 |
| WO | 99/25172 | 5/1999 |

* cited by examiner

DOUBLE DOOR RESTRAINING DEVICE AND METHOD

RELATED APPLICATIONS/PRIORITY CLAIMS

This application is a divisional of and claims priority under 35 USC 120 and 121 to U.S. application Ser. No. 16/580,980, filed Sep. 24, 2019 (now U.S. Pat. No. 11,332,295), that claims the benefit under 35 USC 119(e) of U.S. Provisional Application No. 62/750,222 filed Oct. 24, 2018 and entitled "Double Door Restraining Device and Method", the entirety of both of which are incorporated herein by reference.

FIELD

The disclosure relates to an apparatus and method for use with a double door assembly before and during installation of the double door assembly in a structure.

BACKGROUND

In the building of a structure, a double door assembly may be installed in the structure. The double door assembly includes two typical doors with each door hinged at one side of the double door assembly so that the doors close at the center of the double door assembly and may have a locking mechanism that can lock the two doors shut when the double door assembly has been installed. For example, a double door assembly may be installed in a wall of a bedroom of a residence and the double door assembly may allow a person to open either or both of the doors to walk out onto an outdoor porch or deck of the residence.

The double door assembly may include interior double door assemblies and exterior double door assemblies without a threshold. One significant problem with any double door assembly is that, if there is nothing to hold the double door assembly stable at the middle during shipping and/or installation, the two doors are free to separate or swing open since the locking mechanism has yet to be installed. This separation and/or swinging open of the two doors can cause damage to the entire double door assembly.

Currently, the method to hold the two doors is to attach a 1"×4" wood runner from the bottom of the jamb leg on one side to the bottom of the jamb leg on the other side. Because there is an approximately ⅞" gap from the top of the runner to the bottom of the doors, the manufacturer must use miscellaneous wood strips to build up the space so that the doors do not sag. This method is extremely time consuming, require significant manual labor to install, often requires cutting of scrap or purchased material and requires numerous staples.

Thus, it is desirable to provide a double door assembly device and method that stably restrain the bottom of the door doors and it is to this end that the disclosure is directed.

DETAILED DESCRIPTION OF ONE OR MORE EMBODIMENTS

Figure 1:
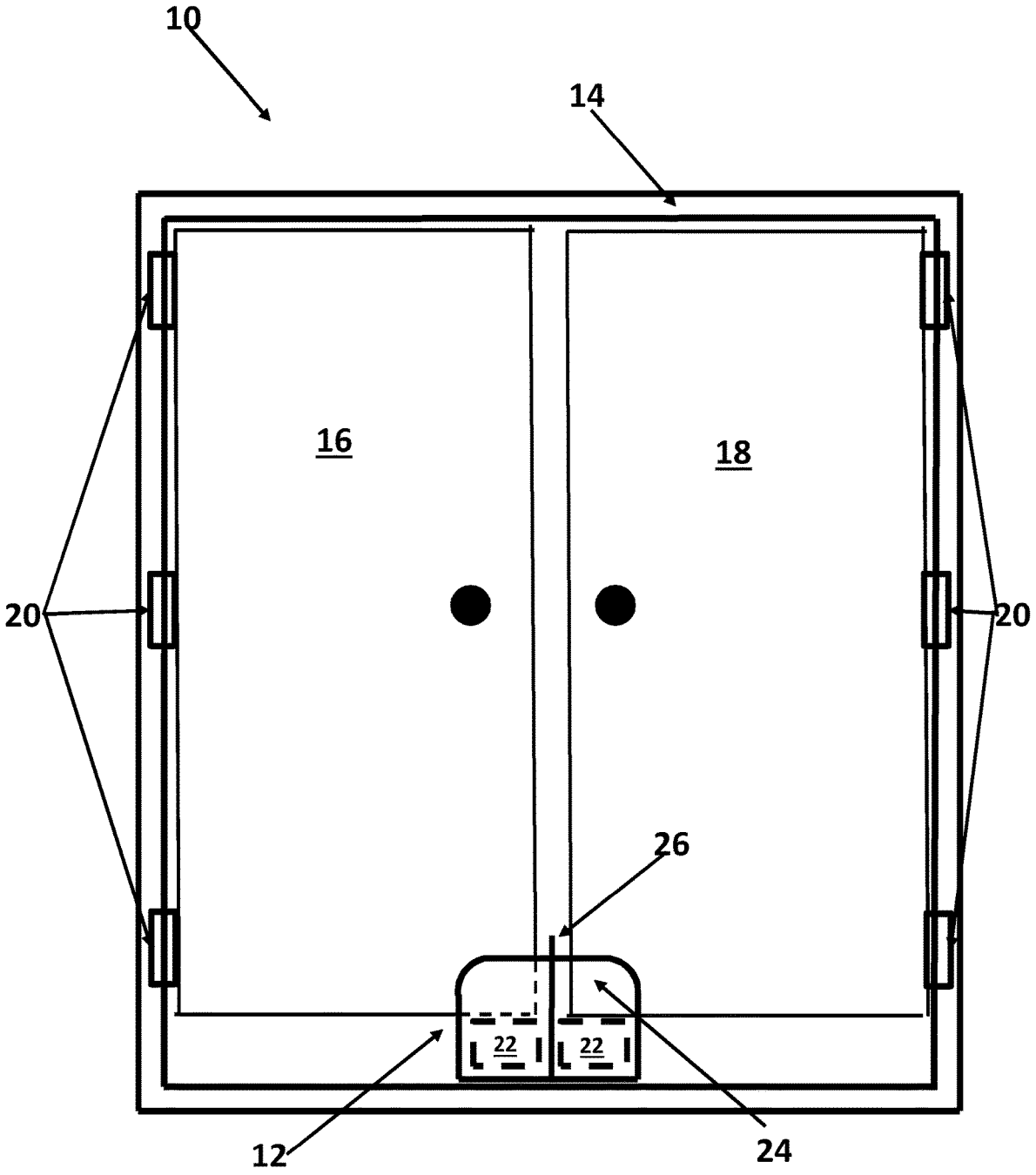
FIG. 1 illustrates an exemplary double door assembly with a double door restraining device installed.

The disclosure is particularly applicable to a double door restraining device that has the configuration shown in the drawings and it is in this context that the disclosure will be described. It will be appreciated, however, that the device and method has greater utility since the double door restraining device can be manufactured out of various materials, although a plastic material is preferred. Furthermore, the double door restraining device may be used for any type of double door assembly including interior double door assemblies and exterior double door assemblies. In addition, the double door restraining device may be used to ship and install a double door assembly in any structure including residential structures and commercial structures. The double door restraining device may also be manufactured in different sizes to accommodate different width or different sized doors.

FIG. 1 illustrates an exemplary double door assembly 10 with a double door restraining device 12 installed. The double door assembly 10 may further include a door frame portion 14 that surrounds a first door 16 and a second door 18. Each door 16, 18 may be attached to the door frame portion 14 by one or more hinges 20 so that each door is closed when the two doors meet at a center as shown in FIG. 1. Once installed, each door may have a locking mechanism or latch installed to allow a user to lock the two doors shut when they meet at a center point of the double door assembly 10.

The double door restraining device 12 may be constructed of a suitable material, such as a suitable plastic in one embodiment, but may be manufactured of other suitable materials. In one embodiment, the double door restraining device 12 may be a single monolithic piece (as shown), but may also be formed with different portions connected together. The double door restraining device 12 may hold each door 16, 18 and the double door assembly 10 stable in all three directions—vertically, horizontally and front to back. In particular, the double door restraining device 12 may have two base portions 22 upon which a bottom portion of each door 16, 18 rests thus stabilizing the double door assembly in the vertical direction and prevent sagging. Furthermore, the double door restraining device 12 may have a set of sidewall portions (with a sidewall portion 24 being shown in FIG. 1) that is connected to the base portions 22 and extends across a bottom corner portion of each door 16, 18. The sidewall portion 24, when the double door restraining device 12 is installed and secured to the assembly 10, prevents the door from swinging open and the hinges 20 prevent the doors 16, 18 from swinging in the other direction so that the sidewall portion 24 provides stability of the double door assembly 10 front to back. The double door restraining device 12 further has a separator portion 26 connected to the sidewall portion 24 that fits in between the two doors 16, 18 and separates the two doors 16, 18 and provides stability of the double door assembly 10 in the horizontal direction. The double door restraining device 12 may be attached to the double door assembly 10 so that it stays in place during shipping and installation.

Figure 2A:
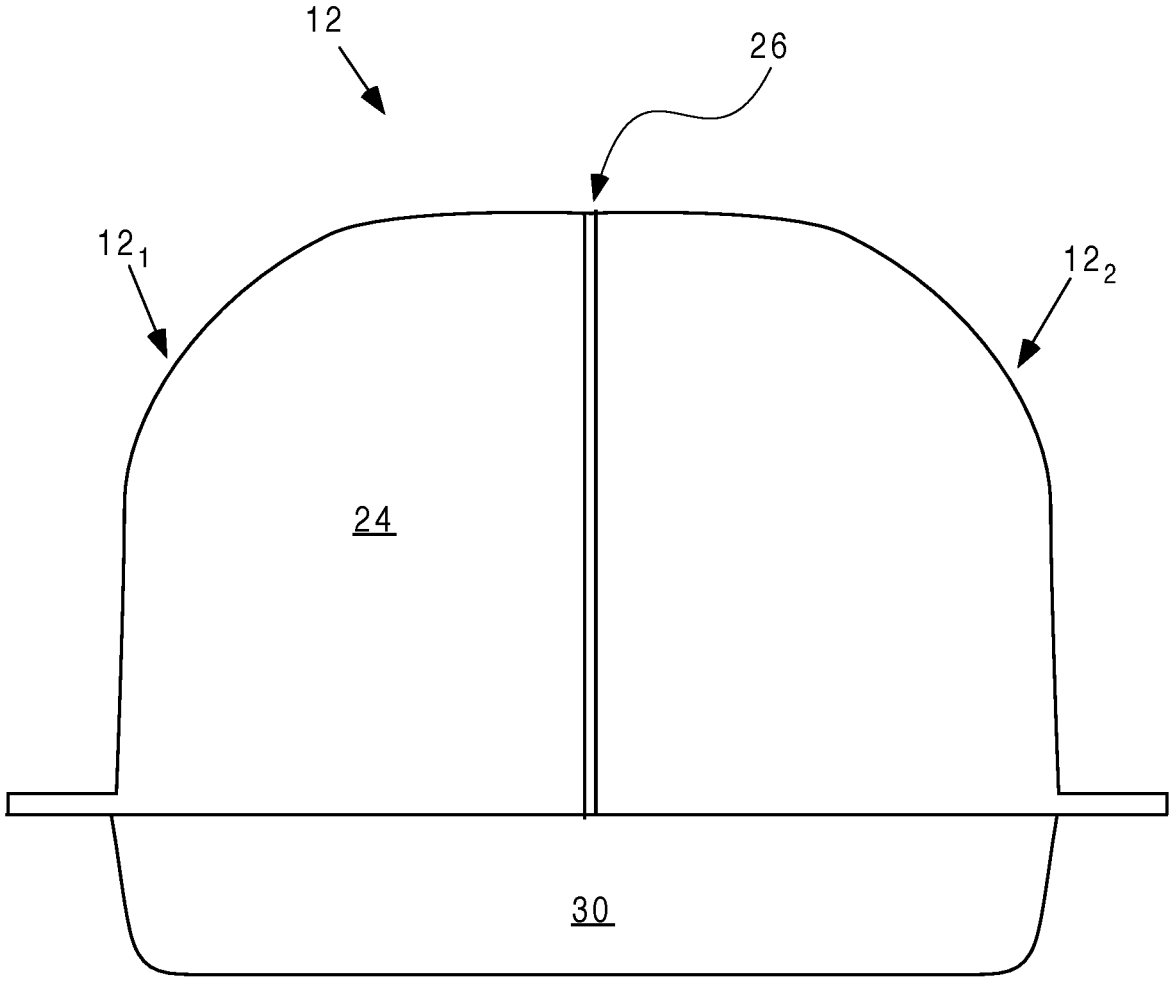
FIGS. 2A and 2B illustrate a front view of the double door restraining device.
Figure 2B:
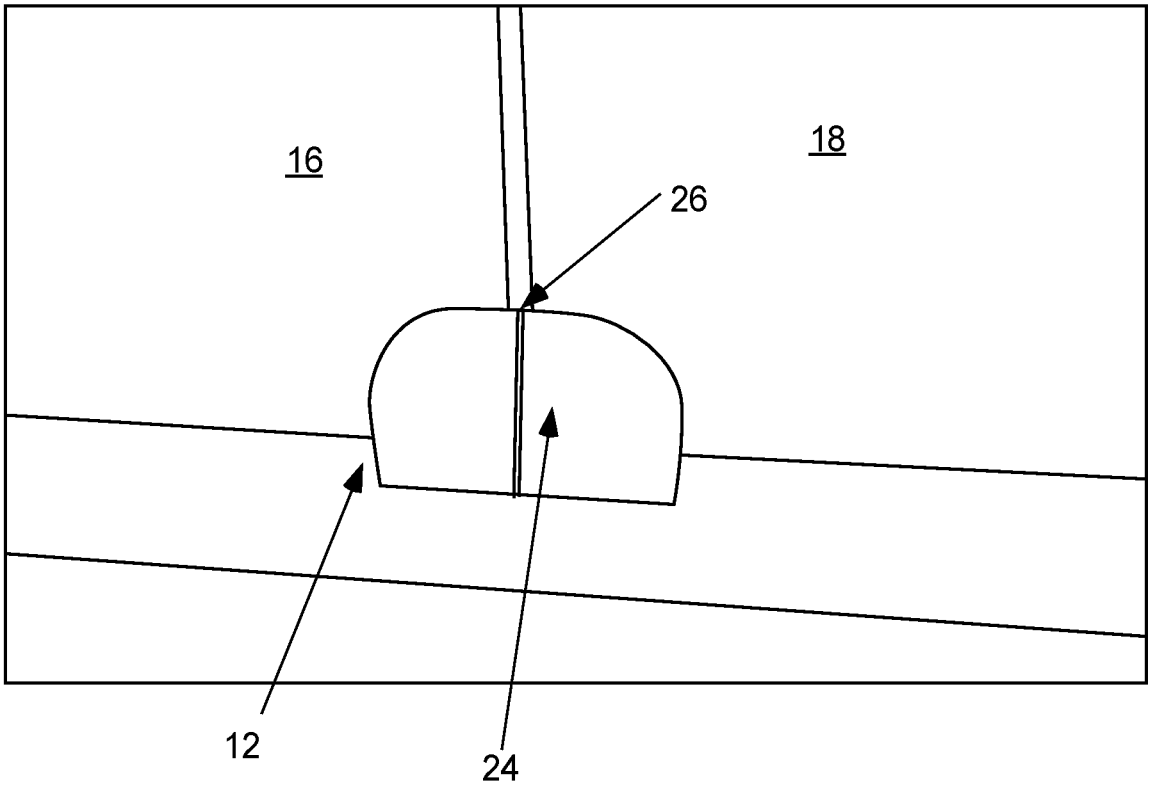

FIGS. 2A and 2B illustrate a front view of the double door restraining device 12 that shows the elements already described above and further shows a tab portion 30 that runs along a length of the device 12 and may be used to connect the device 12 to the double door assembly 10, such as by stapling. The tab portion 30 may be made of the same material as the rest of the device 12, especially when the device 12 is manufactured by injection molding of plastic. Some embodiments of the device 12 may have the tab portion while other embodiments of the device 12 may not have the tab portion 30. As shown in FIG. 2A, the device 12 may include a first retainer mechanism $\mathbf{12}_1$ and a second retainer mechanism $\mathbf{12}_2$ wherein each retainer mechanism holds and supports one of the two doors of the double door assembly.

Figure 3A:
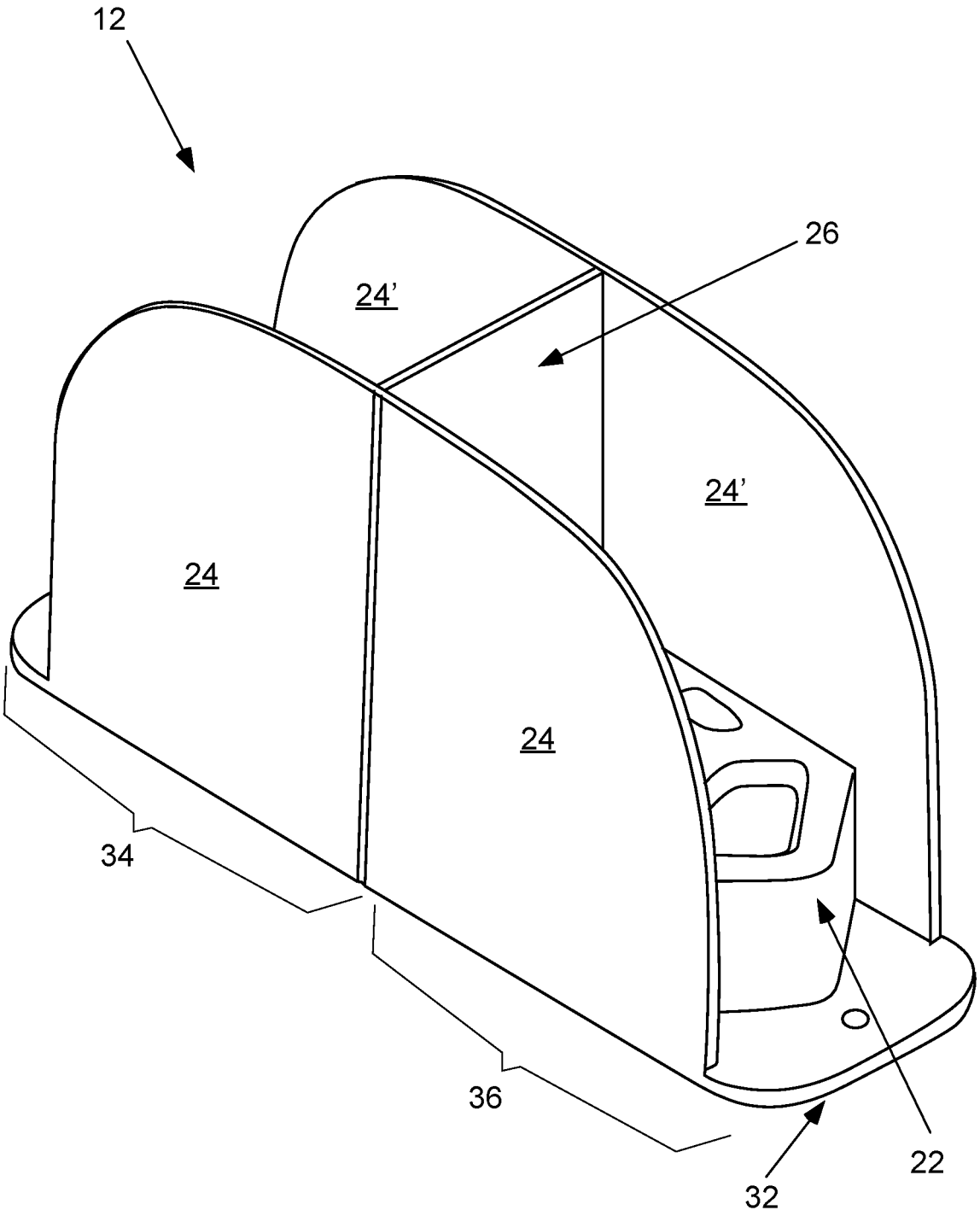
FIGS. 3A and 3B are perspective views of the double door restraining device.
Figure 3B:
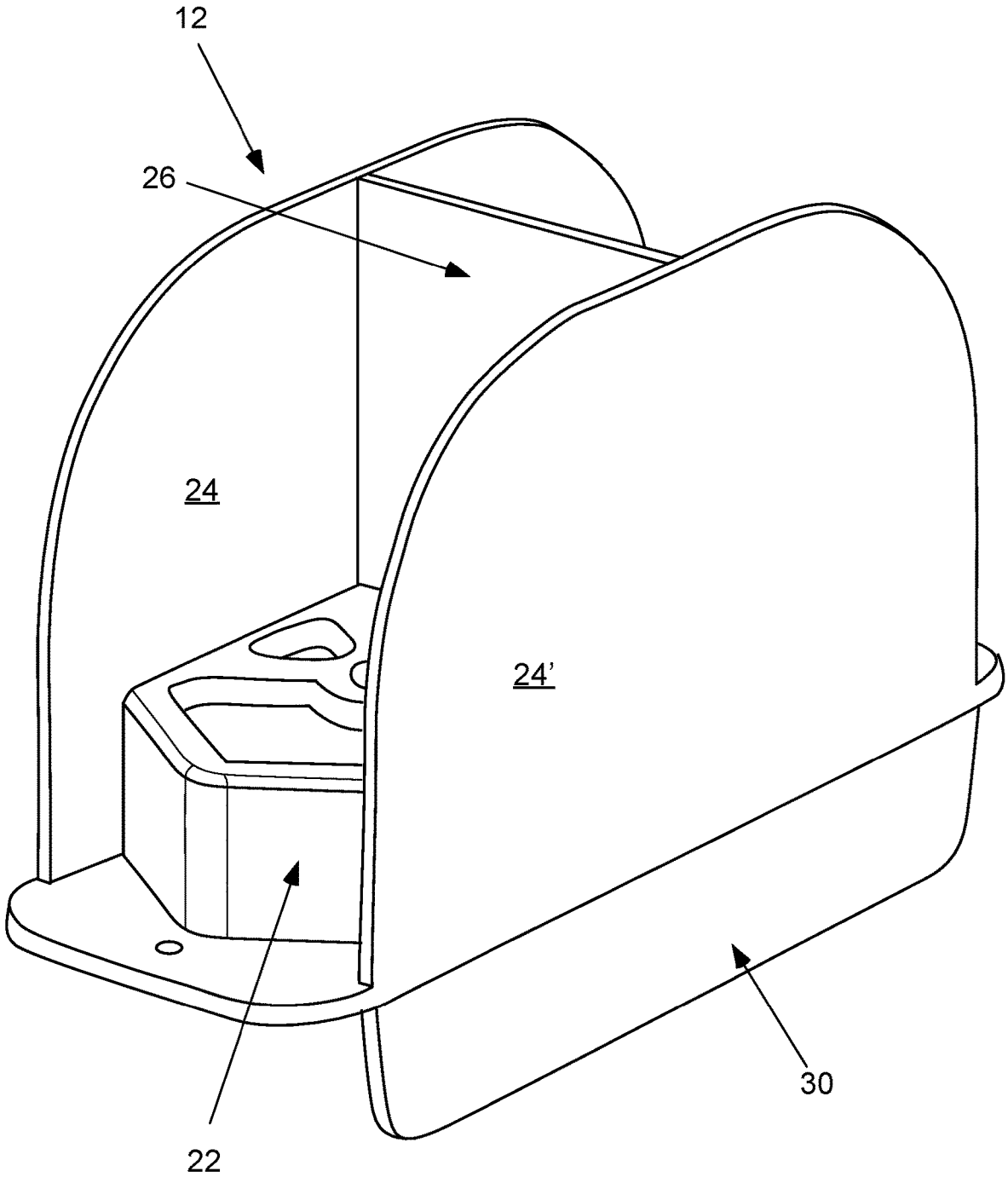

FIGS. 3A and 3B are perspective views of the double door restraining device 12. In the example in FIG. 3A, the device 12 does not have the tab portion while the example in FIG. 3B has the tab portion 30 as shown. The device 12, as shown in these figures, has the set of sidewall portions 24 and 24' spaced apart from each other wherein the gap between the two sidewall portions 24, 24' may be approximately a width of each door of the double door assembly 10 so that the device 12 can snugly secure each door. It is understood that the distance between the two sidewall portions 24, 24' and the width of the base portions 22 may be varied depending on the type of double door assembly and the width of its doors. In general, a different embodiment of the device 12 may be manufactured for each different double door assembly 10.

As shown in FIG. 3A, one of the base portions 22 is shown that supports the door 16, 18 vertically. Each base portion 22 is formed and connected to a bottom portion 32 of the device 12, each sidewall portion 24, 24' of the device 12 and the separator portion 26 of the device. Each base portion 22 as shown in FIGS. 3A and 3B may be formed through injection molding and have the voids as shown, but each base portion 22 may also be solid. Each sidewall portion 24, 24' and the separator portion 26 may also be connected to the bottom portion 32 that acts as a skid plate and protects the double door assembly 10 from damage if the double door assembly 10 is, for example, slid along the floor during shipping and installation. As shown in FIG. 3A, the double door restraining device 12 may have a first door retainer assembly 34 and a second door retainer assembly 36 formed back to back (preferably as a single device) that share the separator portion 36. Each of the first door retainer assembly 34 and the second door retainer assembly 36 may thus include one of the base portions 22, a set of sidewalls 24, 24' and share the separator portion 26.

Figure 4A:
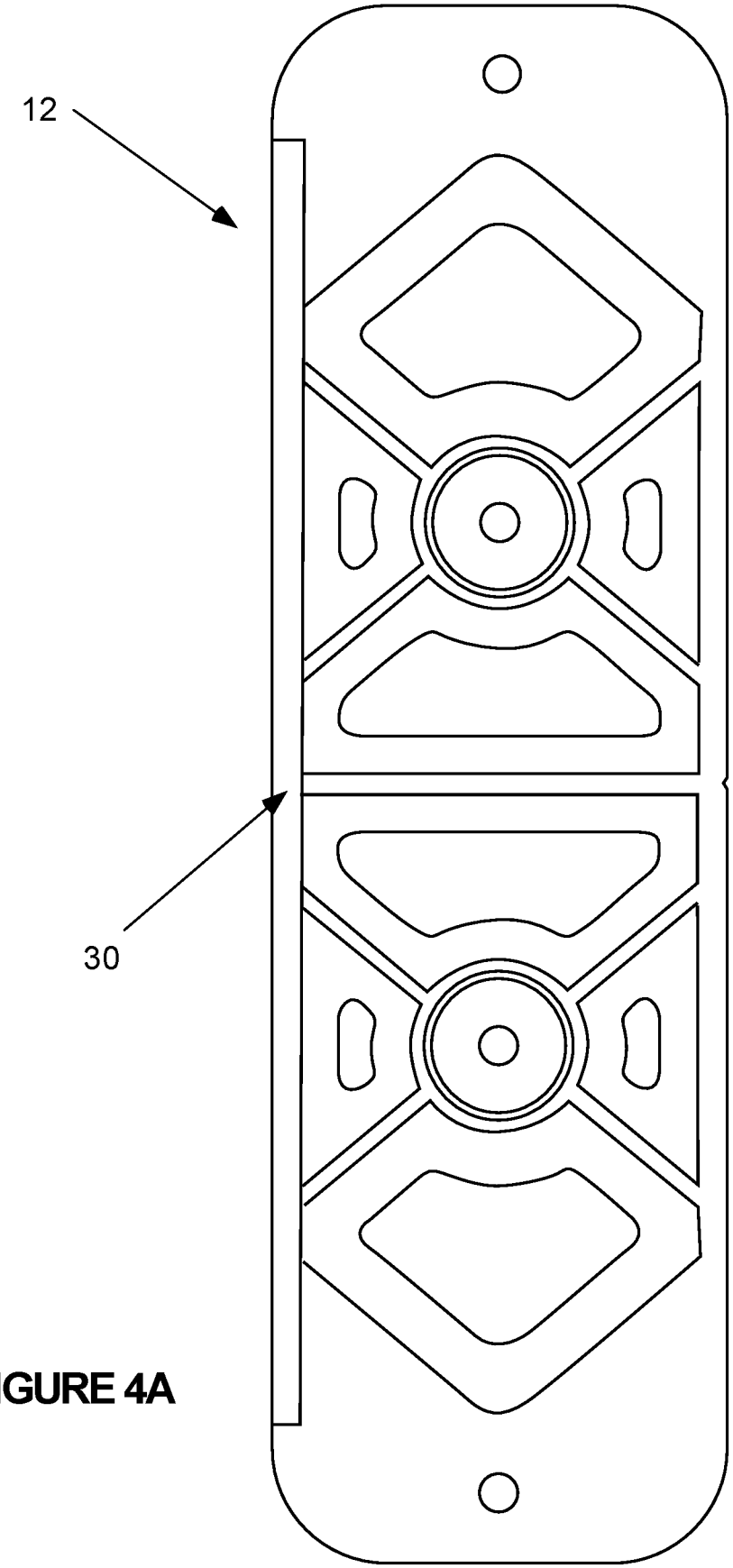
FIGS. 4A and 4B are views of a bottom of the double door restraining device.
Figure 4B:
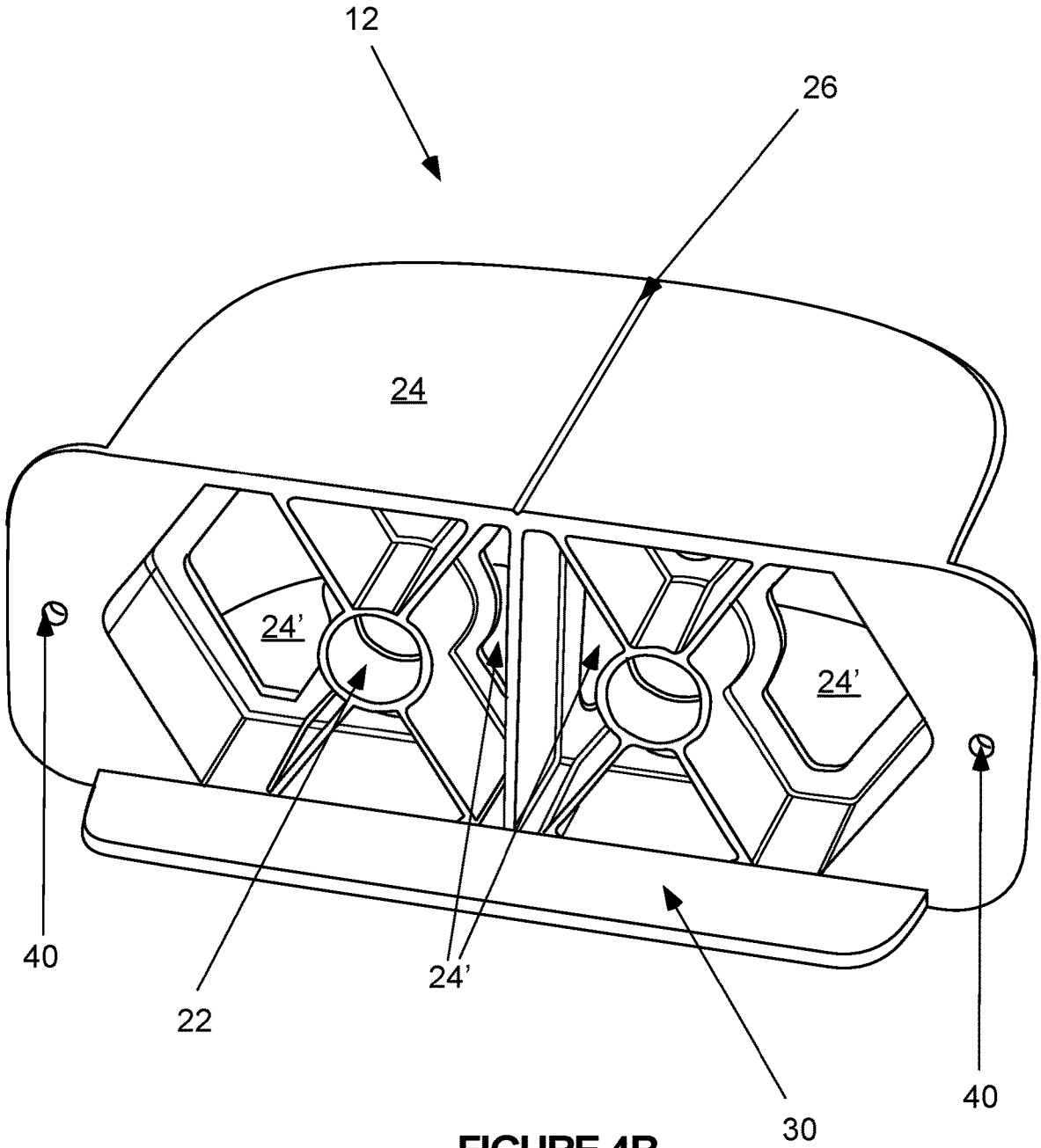
Figure 5:
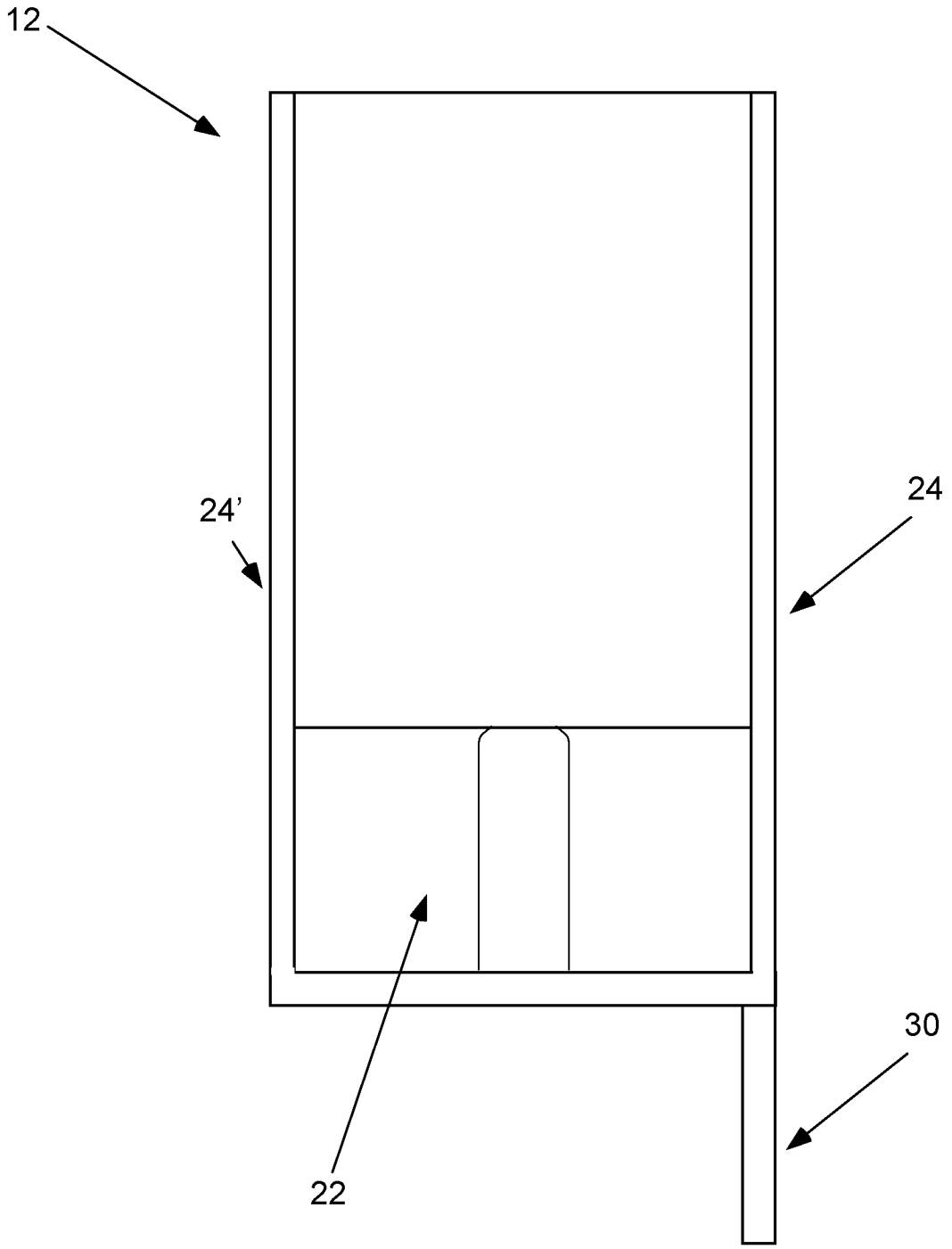
FIG. 5 is a side view of the double door restraining device.

FIGS. 4A, 4B and 5 are views of the double door restraining device 12 that shows an embodiment that has the tab 30 that extends downward from the base portion and base portions 22 may have the voids. Also note that, in this embodiment, the sidewalls 24, 24' may have a varying thickness along their length. Each embodiment of the double door restraining device 12 as shown in FIG. 4B may have a hole 40 on each end of the base portion that may be used to secure the double door restraining device 12 to the double door assembly.

The above described and illustrated double door restraining device 12 holds/restrains a double door unit/assembly (interior units and exterior units without a threshold) stable at the bottom. The double door restraining device 12 easily slides onto the bottom of the doors 16, 18 (see FIG. 2B for example) where they meet in the middle. The user/manufacturer/installer has the option to either screw through the designated holes 22 in the double door restraining device 12 into the bottom of the door slab or apply the 1"×4" runner as described above then staple through the tab 30 into the runner. Screw holes 40 may alternatively be used to screw device 12 to the 1×4" wood runner in lieu of or in conjunction with staples through the flap prior to applying the wood runner with attached device 12 combination to the double door unit assembly.

In use, the double door restraining device 12 may be placed onto a double door assembly at the bottom and secured to the double door assembly to stabilize the double door assembly during manufacture and shipping. Prior to installing the double door assembly in the structure, the double door restraining devise 12 must be removed.

In an alternative embodiment, the double door restraining device 12 may be cut in half so that the restraining device 12 may be used to stabilize a single door.

Figure 6:
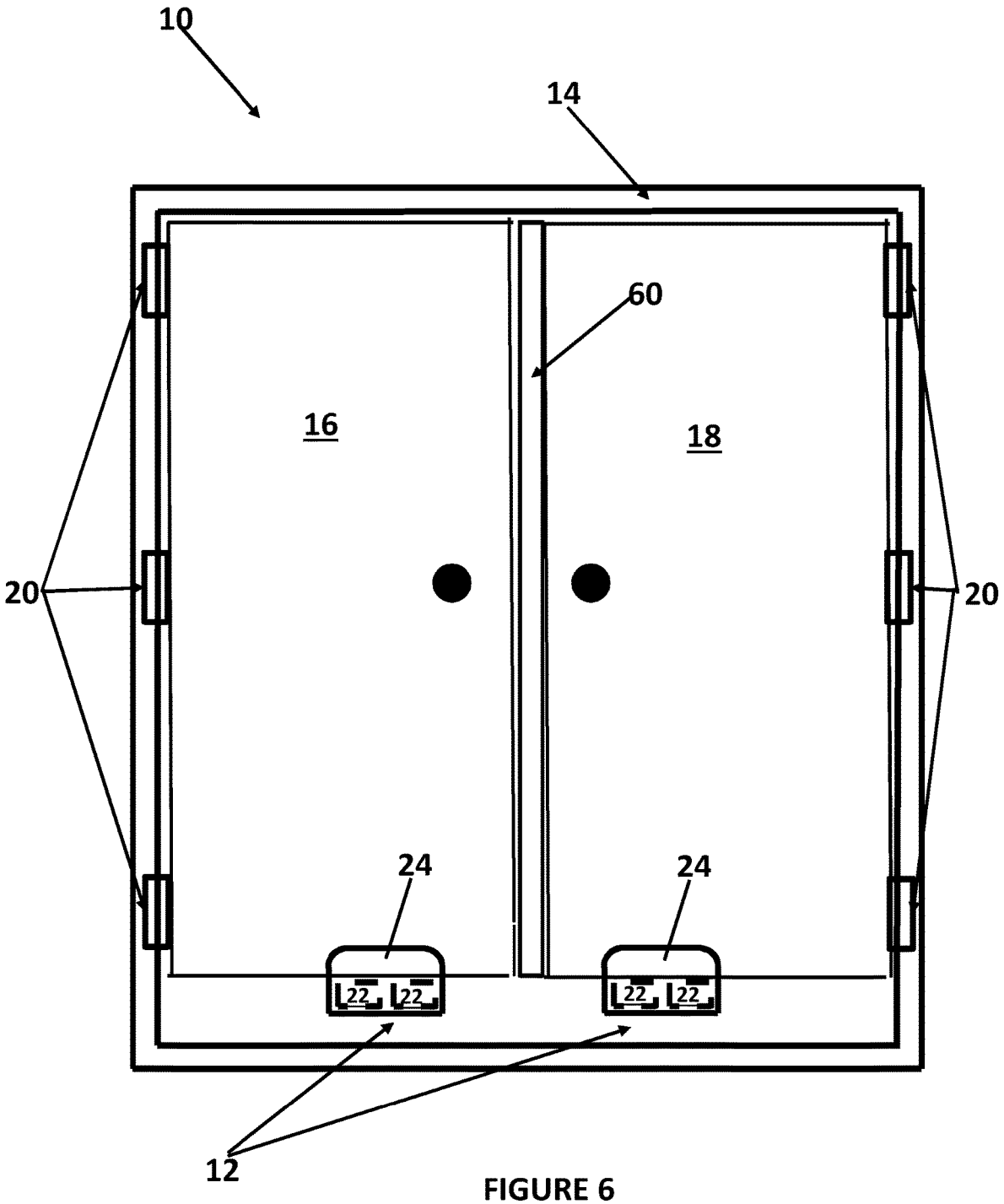
FIG. 6 illustrates an exemplary double door assembly with an astragal with double door retaining devices installed.

FIG. 6 illustrates an exemplary double door assembly with an astragal 60 with double door retaining devices 12 installed. In this embodiment, the double door restraining device 12 may be manufactured in the same manner and material as described above, but without the separator portion 26 (middle cross rib). The astragal 60 may be a metal or plastic piece that runs down the length of the doors as shown in FIG. 6 and may including locking mechanisms or a trim piece that hides the separation between the two doors 16, 18. Like the example in FIG. 1, the double door assembly 10 may include the door frame portion 14 that surrounds the first door 16 and the second door 18. Each door 16, 18 may be attached to the door frame portion 14 by one or more hinges 20 so that each door is closed when the two doors meet at a center as shown in FIG. 6 that may be hidden by the astragal 60 as shown in FIG. 7. Once installed, each door may have a locking mechanism or latch installed to allow a user to lock the two doors shut when they meet at a center point of the double door assembly 10.

As shown in FIG. 6, for a double door with the astragal 60, a first device 12 and a second device 12 (two double door restraining devices that do not have the middle cross rib) are placed adjacent to each door 16, 18 (such as 1.5 inches from the middle although the distance of each device 12 may be varied). Each device 12 may be stapled to a wood runner of the double door assembly to protect the double door assembly with the astragal 60.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. The embodiments were chosen and described in order to best explain the principles of the disclosure and its practical applications, to thereby enable others skilled in the art to best utilize the disclosure and various embodiments with various modifications as are suited to the particular use contemplated. Although certain presently preferred implementations of the invention have been specifically described herein, it will be apparent to those skilled in the art to which the invention pertains that variations and modifications of the various implementations shown and described herein may be made without departing from the spirit and scope of the invention. Accordingly, it is intended that the invention be limited only to the extent required by the applicable rules of law.

While the foregoing has been with reference to a particular embodiment of the disclosure, it will be appreciated by those skilled in the art that changes in this embodiment may be made without departing from the principles and spirit of the disclosure, the scope of which is defined by the appended claims.

What is claimed is:

1. A device, comprising:

a first restrainer assembly having a first base portion capable of vertically supporting a free end opposite of a set of hinges of a first door of a double door assembly and a first set of sidewalls connected to the first base portion spaced apart by a distance equal to a width of each door of the double door assembly, the first restrainer assembly forming a first space bounded by the first set of sidewalls and the first base portion that is configured to be connected to a bottom of the first door and the first set of sidewalls configured to enclose a bottom portion of the free end of the first door;

a second restrainer assembly, connected to the first restrainer assembly, the second restrainer assembly having a second base portion capable of vertically supporting a second free end opposite of a second set of hinges of a second door of the double door assembly and a second set of sidewalls connected to the second base portion spaced apart by the same distance equal to the width of each door of the double door assembly, the second restrainer assembly forming a second space bounded by the second set of sidewalls and the second base portion that is configured to be connected to a bottom of the second door and the second set of sidewalls configured to enclose a bottom portion of the free end of the second door; and wherein the first and second set of sidewalls are parallel to each other and horizontally in line with each other and the first and second spaces are horizontally in line with each other and configured to hold the free ends of the first and second doors adjacent to each other.

2. The device of claim 1 further comprising, a tab portion connected to the first and second base portions and extending away from the first and second set of sidewalls, the tab portion being capable of securing the device to the double door assembly.

3. The device of claim 2 further comprising a set of holes formed in the first and second base portions capable of securing the device to a door slab of the double door assembly.

4. The device of claim 1, wherein each base portion has voids.

5. The device of claim 1, wherein the device is manufactured from plastic.

6. The device of claim 1 further comprising a wall that connects the first set of sidewalls of the first restrainer assembly and the second set of sidewalls of the second restrainer assembly.

7. A device, comprising:

a bottom portion;

a first restrainer assembly connected to the bottom portion that has a first base portion substantially horizontal and vertically above the bottom portion, a first sidewall connected to the bottom portion and spaced away from the first base portion and extending vertically away from the bottom portion and a second sidewall connected to the bottom portion and spaced away from the first base portion wherein the distance between the first and second sidewalls is equal to a width of each door of a double door assembly, the first restrainer assembly forming a first space bounded by the first and second sidewalls and the first base portion; and a second restrainer assembly connected to the bottom portion adjacent the first restrainer assembly, the second restrainer assembly has a second base portion substantially horizontal and vertically above the second portion, a third sidewall connected to the second bottom portion and spaced away from the second base portion and extending vertically away from the second bottom portion and a fourth sidewall connected to the second bottom portion and spaced away from the second base portion wherein the distance between the third and fourth sidewalls is equal to a width of each door of the double door assembly, the second restrainer assembly forming a second space bounded by the third and fourth sidewalls and the second base portion; and wherein the first and third sidewalls and second and fourth sidewalls are parallel to each other and horizontally in line with each other and the first and second spaces are horizontally in line with each other and configured to hold the free ends of the first and second doors adjacent to each other.

8. The device of claim 7, wherein the first and second sidewalls are configured to enclose a bottom portion of a free end of a first door of the double door assembly and the third and fourth sidewalls are configured to enclose a bottom portion of a free end of a second door of the double door assembly.

9. The device of claim 8 further comprising, a tab portion connected to the bottom portion and extending away from the first, second, third and fourth sidewalls, the tab portion being capable of securing the device to the double door assembly.

10. The device of claim 7, wherein each base portion has voids.

11. The device of claim 10 further comprising a set of holes formed in the first and second base portions capable of securing the device to a door slab of the double door assembly.

12. The device of claim 7, wherein the device is manufactured from plastic.

13. The device of claim 7 further comprising a wall that connects the first and second restrainer assemblies.

14. The device of claim 13, wherein the wall connects the first and second sidewalls of the first restrainer assembly and the third and fourth sidewalls of the second restrainer assembly.

* * * * *